US010747179B2

(12) United States Patent
Lagorgette et al.

(10) Patent No.: US 10,747,179 B2
(45) Date of Patent: Aug. 18, 2020

(54) UNIVERSAL MOON PHASE DISPLAY

(71) Applicant: ETA SA Manufacture Horlogere Suisse, Grenchen (CH)

(72) Inventors: Pascal Lagorgette, Bienne (CH); Thierry Bonnet, Geneva (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 119 days.

(21) Appl. No.: 15/922,943

(22) Filed: Mar. 16, 2018

(65) Prior Publication Data

US 2018/0267474 A1 Sep. 20, 2018

(30) Foreign Application Priority Data

Mar. 20, 2017 (EP) ..... 17161772

(51) Int. Cl.

| | |
|---|---|
| ***G04B 19/26*** | (2006.01) |
| ***G04C 17/00*** | (2006.01) |
| ***G04G 21/04*** | (2013.01) |
| ***G04R 20/06*** | (2013.01) |

(52) U.S. Cl.

CPC ..... *G04B 19/268* (2013.01); *G04C 17/0058* (2013.01); *G04G 21/04* (2013.01); *G04R 20/06* (2013.01)

(58) Field of Classification Search

CPC ..... G04B 19/26; G04B 19/268

See application file for complete search history.

(56) References Cited

U.S. PATENT DOCUMENTS

| | | | | |
|---|---|---|---|---|
| 4,881,213 | A * | 11/1989 | Zaslawsky | G04B 19/268 368/15 |
| 5,208,790 | A * | 5/1993 | Sato | G04G 9/0076 368/15 |
| 5,408,444 | A | 4/1995 | Kita et al. | |
| 6,885,614 | B2 * | 4/2005 | Rey-Mermet | G04B 19/268 368/16 |
| 7,196,973 | B2 * | 3/2007 | Born | G04B 19/268 368/15 |
| 7,251,198 | B2 * | 7/2007 | Barton | G09D 3/08 368/18 |

(Continued)

OTHER PUBLICATIONS

European Search Report dated Oct. 6, 2017 in European Application 17161772.3, filed Mar. 20, 2017 ( with English Translation of Categories of Cited Documents).

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A universal moon phase display device for a watch including a device that calculates or receives the date, that receives a geolocation signal, that calculates or receives a lunar calendar with the correlation between the date of the moon phase, that converts the day's moon phase into a first angular position of a first display member included in this device and which includes a representation of the normal moon, and that further determines the northern or southern hemisphere in which this device is located and controls the direction of rotation of first drive device included in this device in order to drive the first display member in opposite directions in the northern hemisphere and in the southern hemisphere.

13 Claims, 9 Drawing Sheets

(56) References Cited

U.S. PATENT DOCUMENTS

| | | | | |
|---|---|---|---|---|
| 8,885,443 | B2 * | 11/2014 | Marzouq | G04G 9/025 368/16 |
| 10,078,309 | B2 * | 9/2018 | Capt | G04B 19/253 |
| 2004/0156269 | A1 * | 8/2004 | Plange | G04B 19/268 368/17 |
| 2006/0007787 | A1 * | 1/2006 | Born | G04B 19/268 368/15 |
| 2009/0274010 | A1 * | 11/2009 | Vuilleumier | G04B 19/26 368/18 |
| 2009/0278312 | A1 * | 11/2009 | Bower | A63F 3/04 273/243 |
| 2010/0226213 | A1 | 9/2010 | Drugge | |
| 2013/0116967 | A1 * | 5/2013 | Akcasu | G04G 9/00 702/150 |
| 2014/0247699 | A1 | 9/2014 | Sembritzki et al. | |
| 2016/0034133 | A1 * | 2/2016 | Wilson | G06F 3/0488 715/772 |

* cited by examiner

UNIVERSAL MOON PHASE DISPLAY

This application claims priority from European patent application No. 17161772.3 filed on Mar. 20, 2017, the entire disclosure of which is hereby incorporated herein by reference.

FIELD OF THE INVENTION

The invention concerns a universal moon phase display device for watches, comprising first means for calculating or for receiving the current date and second means for receiving a geolocation signal and/or a signal indicating the terrestrial hemisphere of a place, said device comprising third means for calculating, as a function of said current date, or for receiving a lunar calendar which comprises at least the correlation between the current date and the moon phase, and position calculating means arranged to convert the day's moon phase into a first angular position value of a first display member comprised in said device and which comprises at least one representation of the normal moon.

The invention concerns a watch including at least one such device.

The invention concerns a portable assembly comprising such a watch and a mobile telephony device arranged to provide a geolocation signal or data and/or a signal or data indicating the terrestrial hemisphere of a place, and/or a date signal or data to such a device comprised in said watch.

The invention concerns the field of moon phase displays for watches.

BACKGROUND OF THE INVENTION

The moon phase display in a watch is a complication which, although old and very popular, often provides a very approximate display, generally designed for European users or users from regions close to the 45th parallel north. Moon phase displays for users from the southern hemisphere, where the appearance of the moon is reversed, are special and consequently more costly, and universal displays for both hemispheres are prohibitively expensive.

The phases of the moon appear differently in the northern and southern hemispheres or close to the equator.

Most moon display watches offer a display suitable for the temperate regions, but this display is not compatible with the appearance of the moon seen from the tropical or equatorial regions.

US Patent Application No. 2014/0247699A1 in the name of Sembritzki discloses a wearable device comprising a display device for displaying the phases of the moon. The image of the one or more moons is provided in the dial, and a rotating element is provided above the dial to provide images of a full, waning, new and waxing moon. The device provides for both bidirectional and unidirectional rotation of the rotating element. The device can simultaneously or selectively display moon phases consistent with views from the northern hemisphere and/or southern hemisphere.

U.S. Pat. No. 5,408,444 in the name of Kita discloses an electronic timepiece having a signal receiving function, the current time at the place where a user is located can be displayed without designating a regional name. The quasi-distance data between the satellites and the signal receiving point is calculated based upon the delay times of the signals transmitted by the satellites. The position data about the signal receiving point is obtained from four quasi-distance data. Subsequently, this position data is compared to the longitude/latitude data previously stored in ROM, to search for a city located nearest this signal receiving point. Furthermore, a judgement is made as to whether or not the current receiving point is coincident with the city located nearest the preceding receiving point. If these cities are coincident with each other, then the current time of the city stored in the time counting register is directly displayed. If no coincidence is established, the time counted by the time counting unit is corrected based upon the time difference data concerning the city located nearest to the current signal receiving point, and the corrected time is associated with the name of this city.

US Patent Application No 2010/0226213A1 in the name of Drugge discloses a timepiece or a wristwatch, which displays celestial 'complications' and meteorological events based upon calculations and conditions relevant to the geographic location of the timepiece. A memory storage device, a microprocessor, mechanical and software controlled graphical display systems and network connectivity facilitate the input of user selected complications, display options, geographic arguments and other variables. The timepiece is not limited to a preprogrammed geographic area or to predefined complications.

SUMMARY OF THE INVENTION

The invention proposes to provide the user with a moon phase display consistent with the place where he is located.

To this end, the invention concerns a universal moon phase display device for watches according to claim 1.

The invention concerns a watch including at least one such device.

The invention concerns a portable assembly comprising such a watch and a mobile telephony device arranged to provide a geolocation signal or data and/or a signal or data indicating the terrestrial hemisphere of a place, and/or a date signal or data to such a device comprised in said watch.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
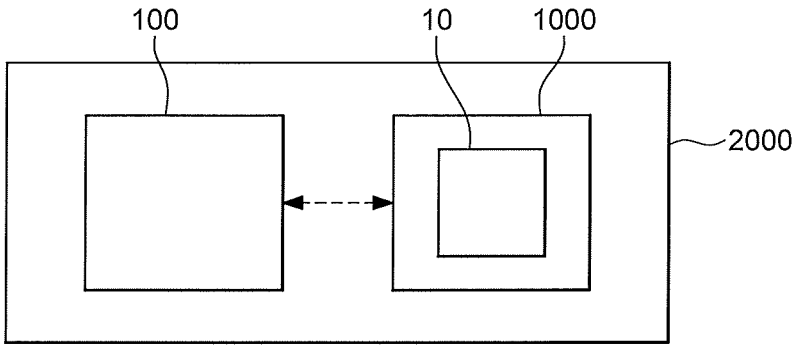
FIG. 1 represents, in a block diagram, a portable assembly comprising a watch and a mobile telephony device arranged to provide a geolocation signal or data and/or a signal or data indicating the terrestrial hemisphere of a place and/or a date signal or data to a device according to the invention, comprised in the watch.
Figure 2:
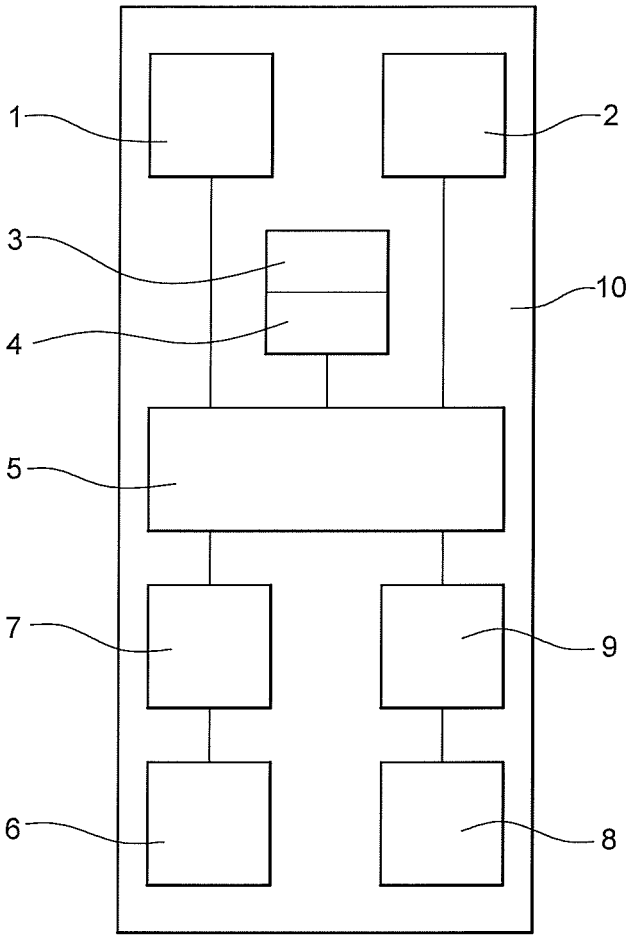
FIG. 2 shows, in a similar manner to FIG. 1, this device and its main constituent elements.

The invention thus concerns a universal moon phase display device 10 for a watch 1000.

This device 10 comprises first means 1 for calculating or receiving the current date, and second means 2 for receiving a geolocation signal.

Device 10 conventionally includes at least a first display member 6, which comprises at least one representation of the normal moon 11. Device 10 comprises first drive means 7 for driving this first display member 6.

This device 10 comprises third means 3 for calculating or receiving a lunar calendar 4, which comprises at least the correlation between the date and the moon phase.

This device 10 further comprises position calculating means 5, which are arranged to convert the day's moon phase into a first angular position value $\alpha L$ of first display member 6, particularly, but not limited to a moon disc.

According to the invention, these position calculating means 5 are further arranged to determine the northern or southern hemisphere in which device 10 is located, and to control the direction of rotation of first drive means 7 in order to drive first display member 6 in a first direction in the northern hemisphere or in a second opposite direction in the southern hemisphere.

Figure 3N:
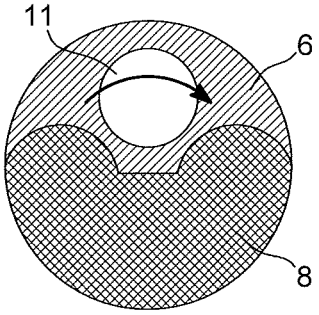
FIGS. 3N and 3S respectively illustrate the direction of travel of the moon in the northern hemisphere and in the southern hemisphere, the representation of the moon being affixed to a first display member, which is a disc here, movable with respect to a second display member, which is a fixed cover here.
Figure 3S:
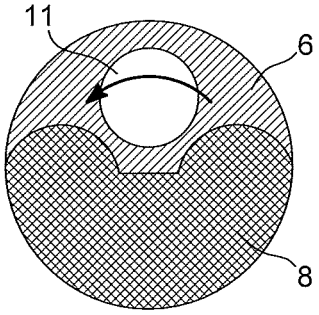

FIGS. 3N and 3S respectively illustrate the direction of travel of the moon in the northern hemisphere and in the southern hemisphere.

Figure 4N:
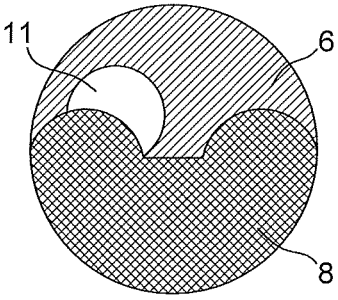
FIGS. 4N and 4S illustrate, in the same manner, the different representations of the moon, at the same instant, in these two hemispheres.
Figure 4S:
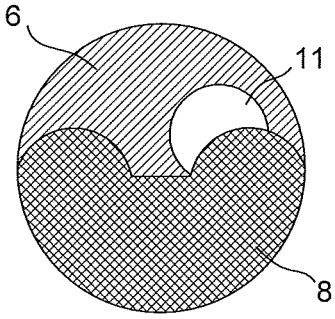

FIGS. 4N and 4S illustrate, in the same manner, the different representations of the moon, at the same instant, in these two hemispheres.

More particularly, first drive means 7 comprise at least a first electric motor, which is arranged to rotate in both directions of rotation, so as to drive first display member 6 in a first direction between a beginning-of-lunation position and an end-of-lunation position in order to complete one travel in a lunar month, on a limited angular travel of strictly less than 360°, and in order to drive first display member 6, at the end of a lunation, in a second direction opposite to the first direction between the end-of-lunation position and the beginning-of-lunation position in a fast, substantially instantaneous backward motion.

Figure 5:
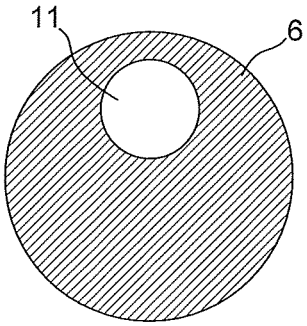
FIG. 5 represents a schematic, front view of a first display member with a single representation of the moon.

FIG. 5 illustrates a first display member 6 that comprises a single moon representation which is the normal moon representation 11.

Figure 7:
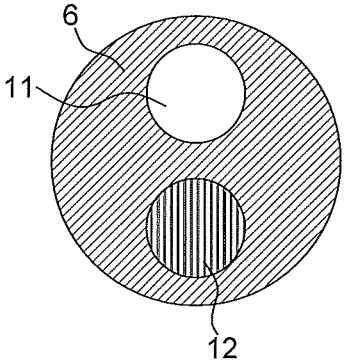
FIG. 7 represents, in a similar manner, a first display member with two representations of the moon, a normal moon and a blood moon.

This particular arrangement, with a first electric motor arranged to rotate in both directions of rotation, also makes it possible to use a same display member 6 that comprises several representations of the moon, such as, for example, that of FIG. 7, which comprises a normal moon representation 11 and a representation of the blood moon 12, which are diametrically opposite in the particular example of FIG. 7. To avoid displaying the element opposite to the appropriate moon representation, first display member 6 makes return movements, which are permitted by the two directions of rotation of the first electric motor.

In a particular variant, lunar calendar 4 includes the dates of total lunar eclipses and blood moon days, and first display member 6 then comprises, in distinct angular positions, at least one normal moon representation 11 which is displayed by default and at least one blood moon representation 12. Position calculating means 5 are arranged to effect a suitable rotation of first drive means 7 to substitute a blood moon representation 12 for a normal moon representation 11, when the current date corresponds to a blood moon date. For example, normal moon representation 11 is diametrically opposite blood moon representation 12 on the same moon disc, and position calculating means 5 effect a rotation offset by 180° in the case of a blood moon, with respect to the calculation made for a normal moon. The blood moon is predictable, after total lunar eclipses and after the April full moon, and lunar calendar 4 can easily manage the dates. Since eclipses and red moons are long-term predictable events, it is not essential to calculate the position of the day in the lunar month, if this has been conclusively done beforehand. The dates can be determined using either an external resource, or an internal memory.

In a particular variant, device 10 comprises a second display member 8, which includes at least one representation of the horizon, with respect to which first display member 6 is movable. More particularly, this second display member 8 forms a cover in superposition with one portion of first display member 6. This second display member 8 can form a conventional static mask member. More particularly, this second display member 8 is movable at least in a concentric rotation with first display member 6, to provide a realistic rendering of the moon phase. More particularly still, this second display member 8 is movable at least in translation, particularly but not limited to a radial translation, with respect to first display member 6.

Figure 6:
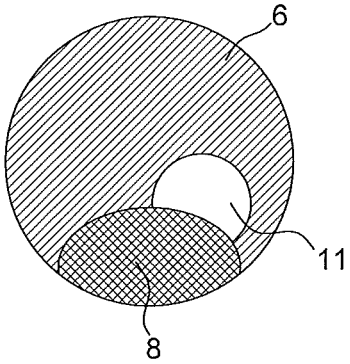
FIG. 6 represents the same first display member behind a second display member featuring an off-centre horizon, as seen at certain latitudes.
Figure 18:
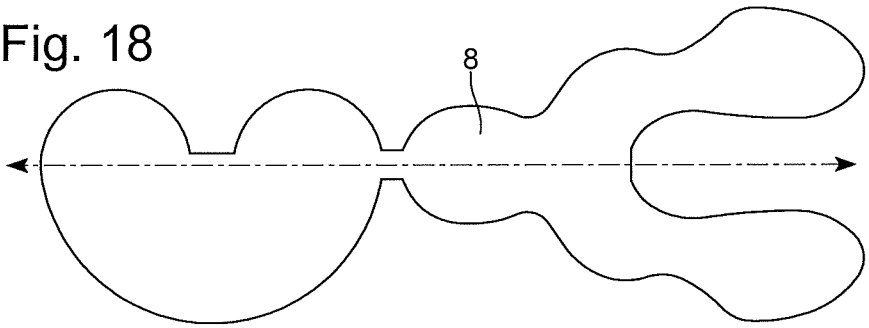
FIG. 18 illustrates an example of a combined mask member on a second display member devised to be moved in translation to better fit a range of predefined latitudes.
Figure 19:
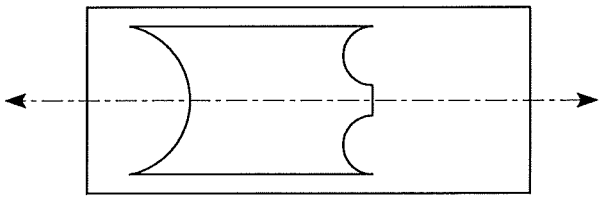
FIG. 19 illustrates another example of such a combined mask member.
Figure 16A:
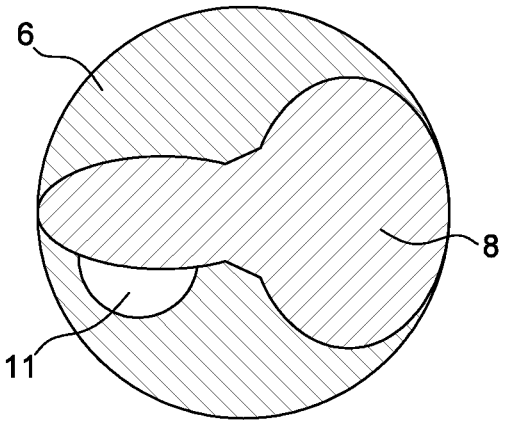
FIGS. 16A-16L and 17A-17L illustrate the succession of lunar phases, with particular second display members, suitable for representation in the tropical regions.
Figure 16B:
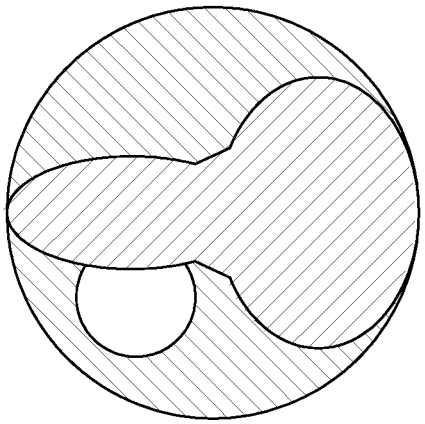
Figure 16C:
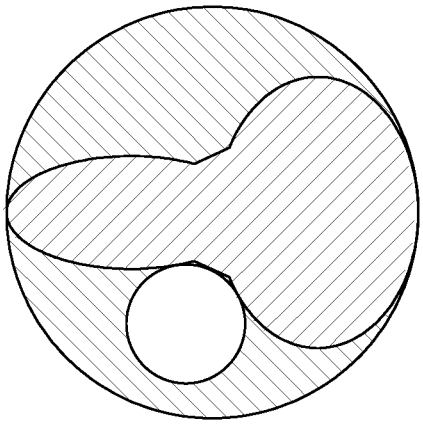
Figure 16D:
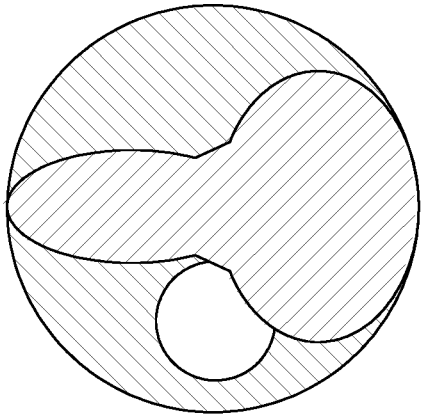
Figure 16E:
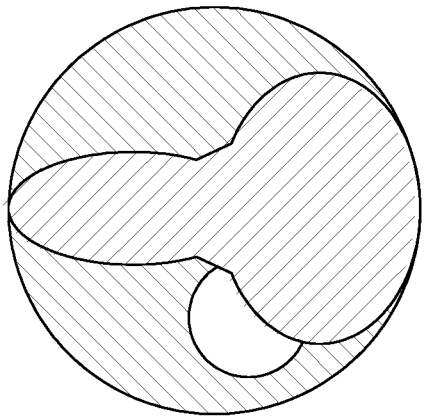
Figure 16F:
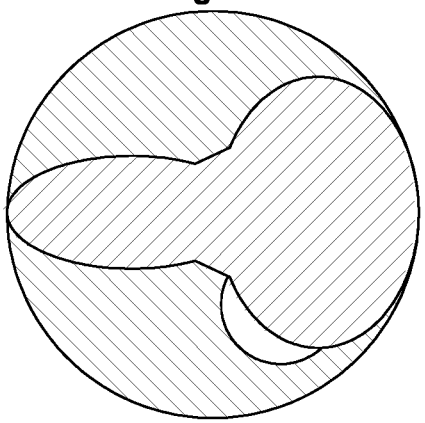
Figure 16G:
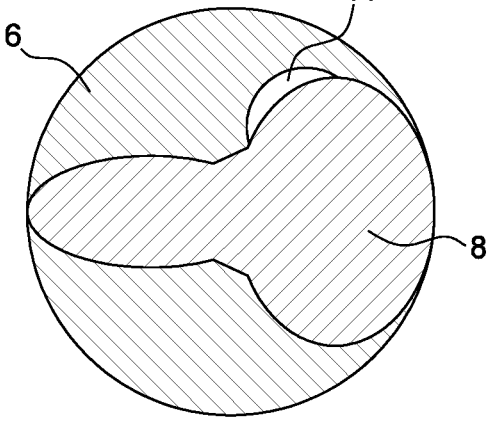
Figure 16H:
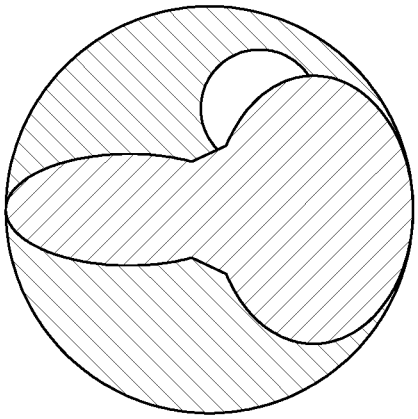
Figure 16I:
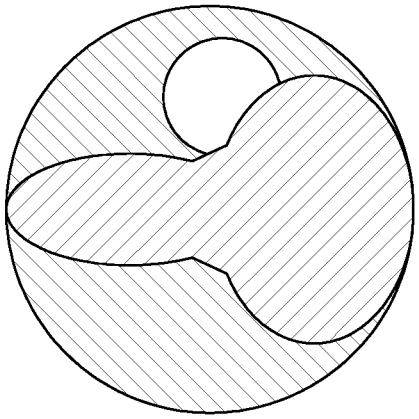
Figure 16J:
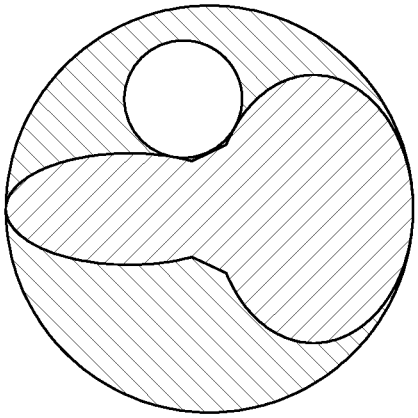
Figure 16K:
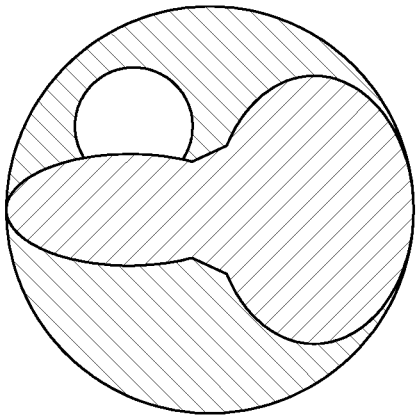
Figure 16L:
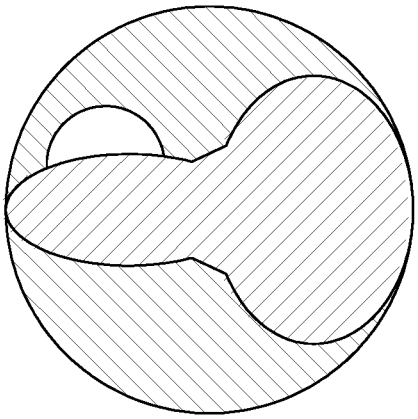
Figure 17A:
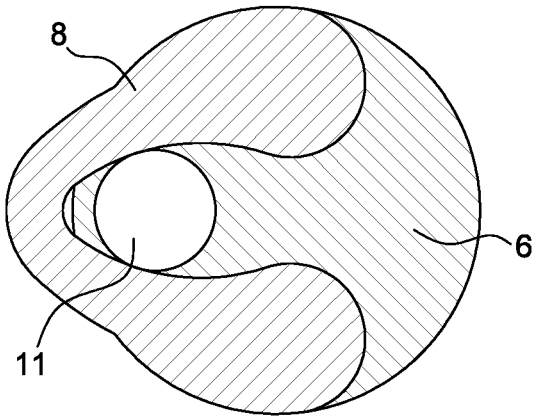
Figure 17B:
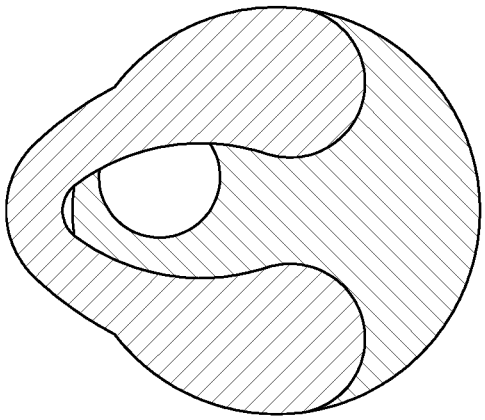
Figure 17C:
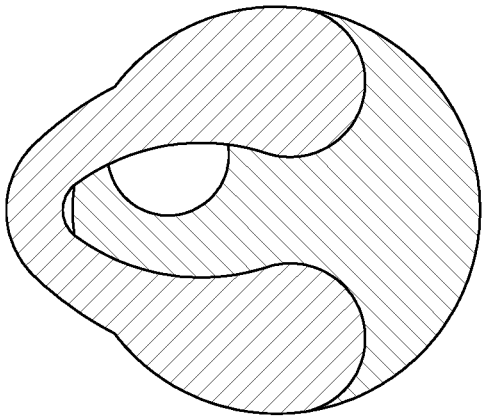
Figure 17D:
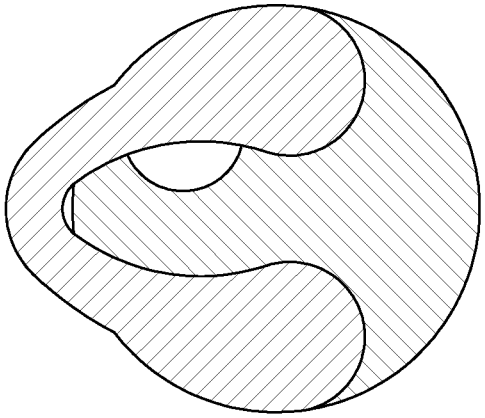
Figure 17E:
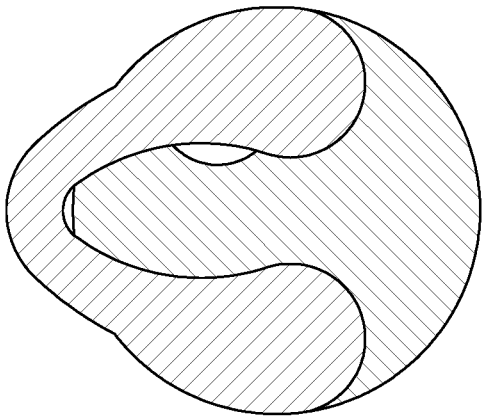
Figure 17F:
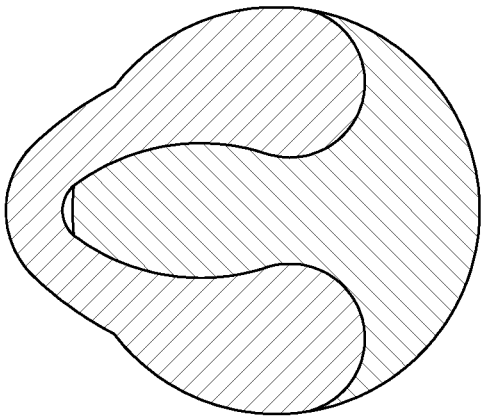
Figure 17G:
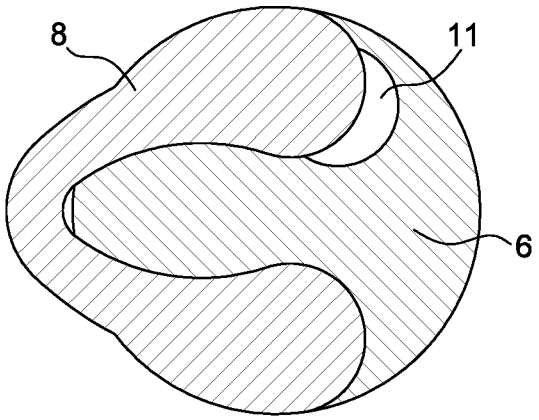
Figure 17H:
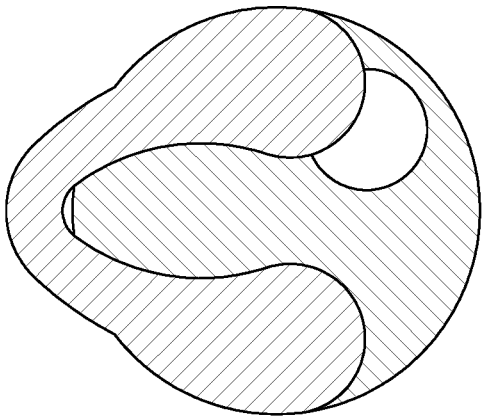
Figure 17I:
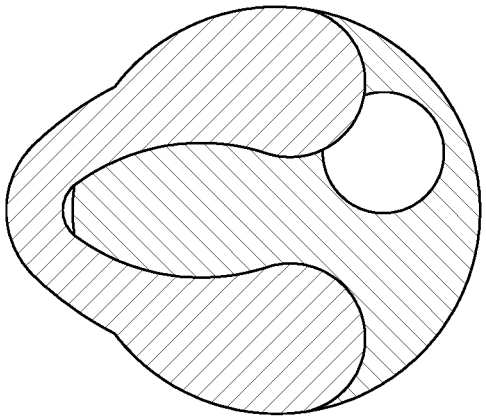
Figure 17J:
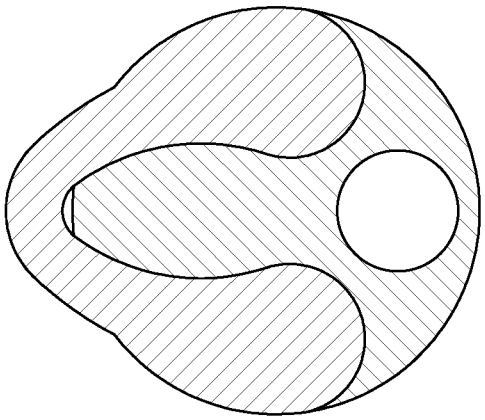
Figure 17K:
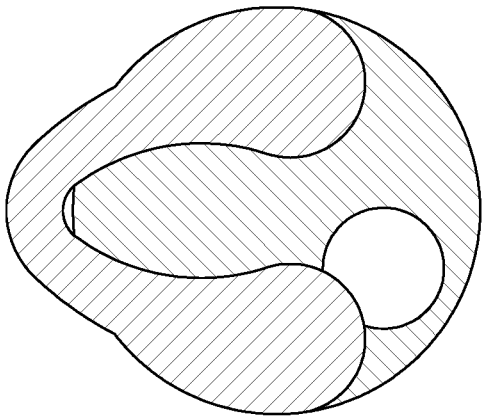
Figure 17L:
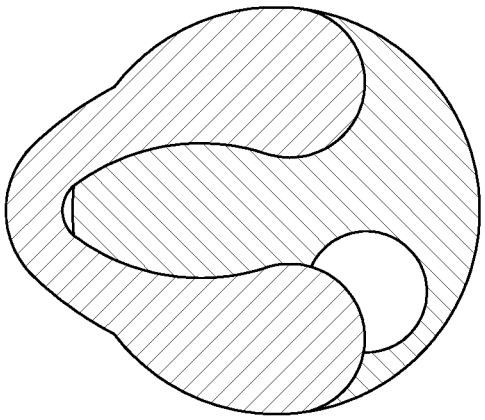

FIGS. 3 and 4 represent conventional profiles of second display member 8, used in ordinary moon phase displays for the temperate regions. FIG. 6 illustrates another variant representation. In fact, the tropical, equatorial and polar regions require different-shaped covers to better depict the real appearance of the moon in these regions, in its different phases, as shown, in particular, in FIGS. 16A-16L and 17A-17L devised for the tropical regions. FIG. 18 illustrates an example of a mask member on a second display member 8 devised to be moved in translation to best fit a range of predefined latitudes, and comprises in succession the mask member of FIGS. 3 and 4, and those of FIGS. 16A-16L and 17A-17L. FIG. 19 illustrates another example of a combined mask member which successively comprises the mask members of FIGS. 6 and 3.

Position calculating means 5 can advantageously utilise second, geolocation signal receiving means 2, to determine the latitude of the place. Utilisation of this parameter can provide a display with a much more realistic rendering of the appearance of the moon. This realistic display can be obtained with the use, for certain latitudes, of a second particular display member 8, as seen in FIG. 16A-16L or 17A-17L wherein second display member 8 is immobile once placed in superposition with first display member 6, which alone is movable, particularly in rotation.

In a particular variant, second display member 8 is movable with respect to first display member 6, in rotation and/or in translation. More particularly, second display member 8 is movable at least in radial translation with respect to first display member 6.

Thus, in an advantageous variant, position calculating means 5 are arranged to calculate the latitude of the place where device 10 is located, and to control second drive means 9 comprised in device 10 to drive second display member 8 with respect to first display member 6.

FIG. 16, numbered sequentially from 16A to 16L, and FIG. 17, numbered sequentially from 17A to 17L, illustrate two non-limiting examples of particular configurations of second display member 8.

Preferably, device 10 thus comprises an electromechanical mechanism for moving the horizon. In a particularly simple embodiment, a rack is driven by means of a pinion coupled to the motor. It is also possible to implement another principle that only uses pivoting (without translation), simply pivoting the horizon, or with a pantograph type system.

Taking latitude into account for a realistic display, with a horizon that is movable, at least in rotation, with respect to the moon disc, but also, in a particular variant, in radial translation with respect to the axis of the moon disc, can offer a functionality which is not generally handled well in moon phase displays.

In a particular variant, first drive means 7 comprise at least a first electric motor which is arranged to rotate in only one direction of rotation. Position calculating means 5 are, in that case, arranged to control the speed of first drive means 7, so as to drive first display member 6 at a first speed, in a first travel wherein the at least one normal moon representation 11 is visible, between a beginning-of-lunation position and an end-of-lunation position so as to effect one complete travel in a lunar month, in a limited angular travel strictly less than 360°, and so as to drive first display member 6, at the end of the lunation, at a second speed at least thirty times higher than the first speed, in a second travel wherein the at least one normal moon representation 11 is not visible, between the end-of-lunation position and the start-of-lunation position in a movement of duration less than or equal to one day.

Figure 8:
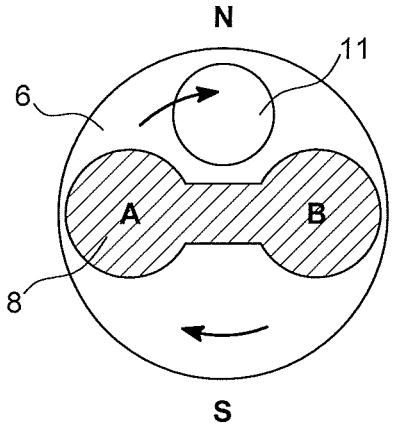
FIG. 8 represents the first display member of FIG. 5, moved by a unidirectional motor but at a variable speed, behind a second display member that can be used for both the northern and southern hemispheres.
Figure 9:
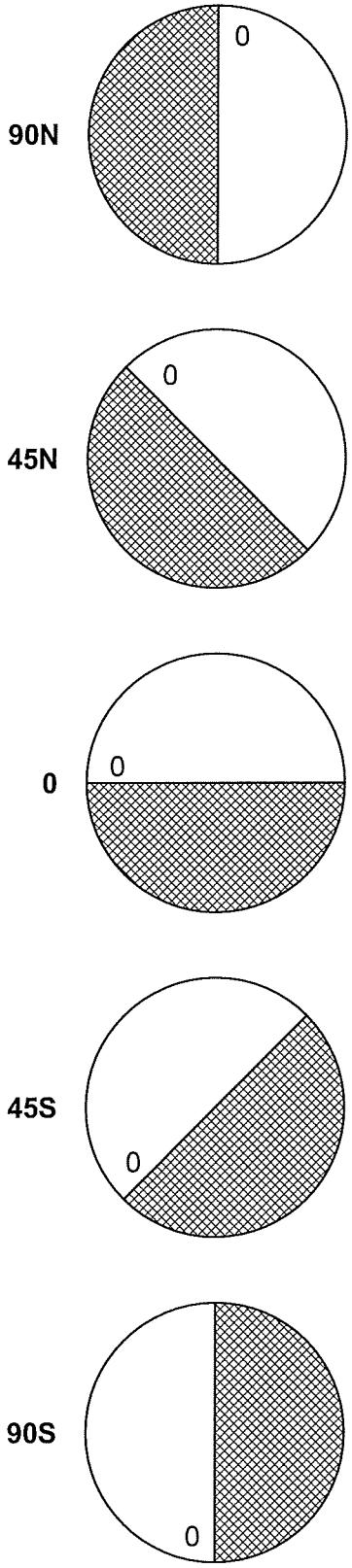
FIG. 9 illustrates the different appearances of the same moon phase, at the same instant, at different latitudes.

FIG. 8 illustrates such a configuration, with a first display member 6 comprising a single normal moon representation 11, and which always rotates in the same direction. In the northern hemisphere, as represented, normal moon representation 11 moves from cover A to cover B of second display member 8, remains concealed underneath part B at the end of the lunation, then moves directly underneath cover A again to start a new period again. In the southern hemisphere, it is the reverse: normal moon representation 11 moves from cover B to cover A of second display member 8, remains concealed underneath part A at the end of the lunation, then directly moves back underneath cover B to start another new period.

In a variant, first means 1 for calculating or receiving the current date are means for receiving a signal transmitted by a satellite or by a mobile telephony device 100 arranged to be carried by the user of watch 1000.

In a variant, second means 2 for receiving a geolocation signal and/or a signal indicating the terrestrial hemisphere of a place are means for receiving a signal transmitted by a satellite or by a mobile telephony device 100 arranged to be carried by the user of watch 100.

In a variant the third means 3 for calculating or receiving a lunar calendar 4 are means for receiving a signal transmitted by a satellite or by a mobile telephony device 100 arranged to be carried by the user of watch 1000.

Such a mobile telephony device 100 may consist of a 'smartphone' or similar, with which watch 1000 can exchange information, without necessarily involving action by the user.

More particularly, a WOP (watch optical programming) method for transmission between a mobile telephony device 100 and a watch 1000 makes it possible to transmit the user's location to the watch, and modify the moon phase display, or other displays, such as the sunrise and sunset, or tides. Other protocols such as Bluetooth Low Energy or NFC can be used to send this information to the watch.

Mobile telephony device 100 knows the user's location via different techniques:

GPS which gives longitude and latitude;

presence in a country that is determined both by GPS and the cellular network to which the telephone is connected.

Mobile telephony device 100 can transmit this information in different formats:

latitude: positive in the northern hemisphere—negative in the southern hemisphere;

in coding bits (2 bits): northern hemisphere—southern hemisphere—Equator—Pole.

country code used to determine whether a daylight saving time (DST) correction needs to be made.

For the moon phase calculation, the WOP protocol transmits the date, so that the moon disc can indicate the correct moon phase. The lunar period is 29.53 days, the appearance of the moon is usually described in lunar days numbered from 1 to 29, the lunar cycle is usually divided into 8 phases, each lasting around 88 hours.

Figure 10:
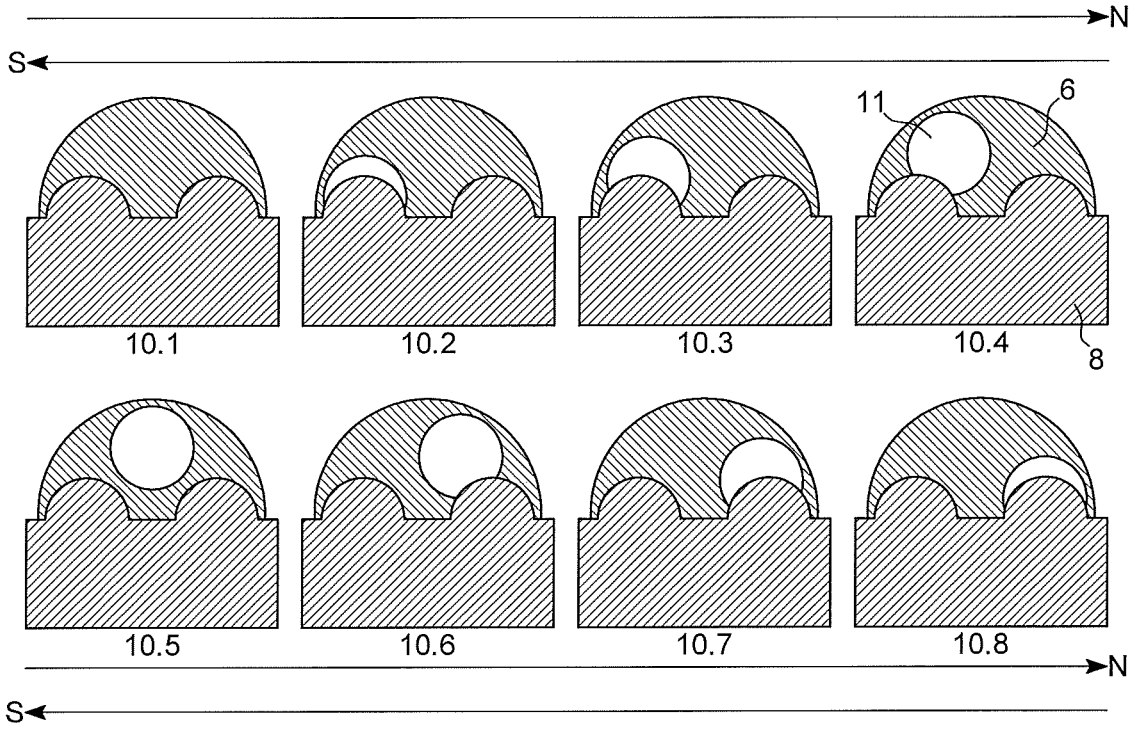
FIG. 10 illustrates the succession of lunar phases, and their direction, in both the northern and southern hemispheres.

These phases are, in the northern hemisphere and in this order, seen in FIG. 10: new moon 10.1, waxing crescent 10.2, first quarter 10.3, waxing gibbous 10.4, full moon 10.5, waning gibbous 10.6, last quarter 10.7, waning crescent 10.8

Whereas in the southern hemisphere, in the same FIG. 10, there is, in this order: waxing crescent 10.8, first quarter 10.7, waxing gibbous 10.6, full moon 10.5, waning gibbous 10.4, last quarter 10.3, waning crescent 10.2, new moon 10.1.

To calculate the lunar day on a certain date, it is necessary to know the lunar day on one defined date, calculate the number of days until the date concerned, and then perform a modulo operation with 29.53 as divisor, the result of which represents the number of the lunar day.

The invention also concerns a watch 1000 including at least one such device 10.

The invention concerns a portable assembly 2000, comprising such a watch 1000, and a mobile telephony device 100 arranged to provide a geolocation signal or data and/or a signal or data indicating the terrestrial hemisphere of a place, and/or a date signal or data to a device 10 comprised in watch 1000.

Figure 11:
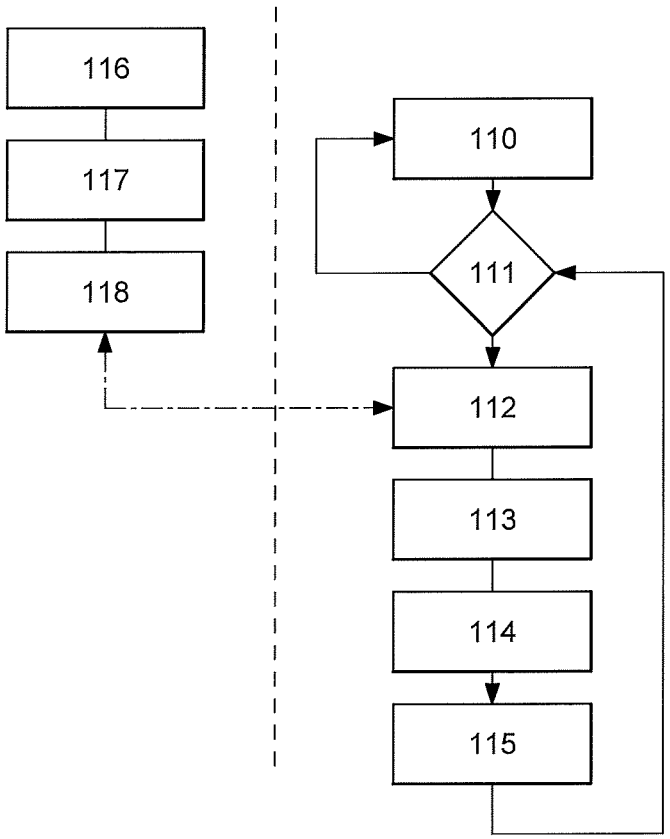
FIG. 11 is a moon phase display control algorithm.

FIG. 11 illustrates a non-limiting example of a moon phase display control algorithm. In watch 1000, function 110 is management of the time of the watch, in step 111 the test is performed at midnight. The lunar day calculation is performed in step 112 based upon elements received from mobile telephony device 100: Step 116: GPS or similar localization; step 17: use of a memory or server to determine total lunar eclipses and red moons; step 118: transfer to the watch. Step 113 is the lunar phase calculation step, taking account of the date and location, and in particular the hemisphere, supplemented where necessary by the occurrence in step 114 of an eclipse or blood moon, to display the moon phase in step 115, with the appropriate type of moon (normal moon or blood moon).

Figure 12:
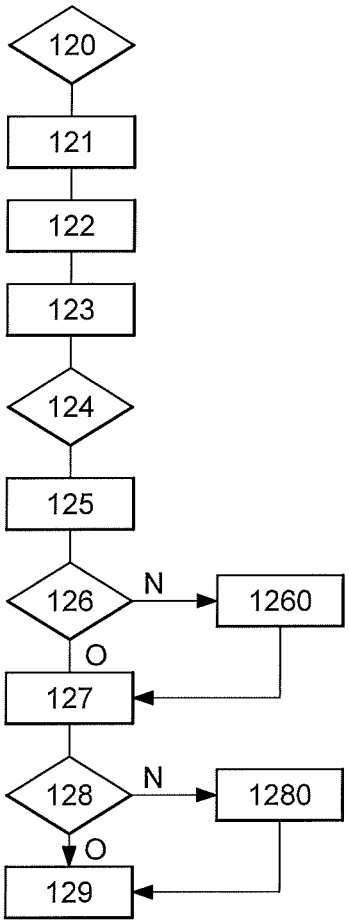
FIG. 12 is another example control algorithm.

FIG. 12 illustrates another non-limiting example algorithm: 120: hemisphere search; 121: use of geolocation and/or indication of terrestrial hemisphere of the place; 123: determination of hemisphere; 124: direction of rotation of the motor of the first display member; 124: taking account of latitude to orient the moon in step 125; 126: date search with direct internal calculation or via external means in 1260, for determination of the date in step 127; internal lunar calendar search in step 128 or via external means in step 1280, to determine, in step 129, the angle of rotation $\alpha L$ imparted to motor 7.

Figure 13:
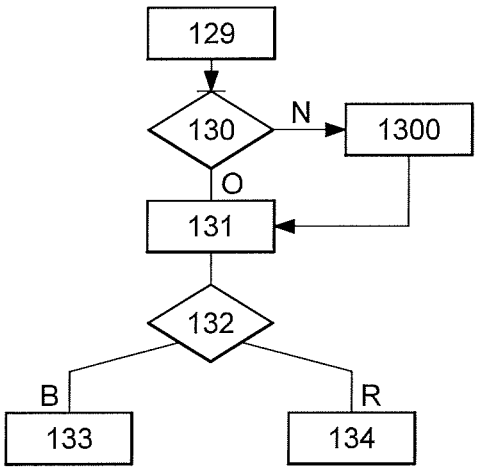
FIG. 13 is an algorithm for management of the blood moon.

FIG. 13 illustrates a blood moon control algorithm including: step 130: a blood moon search performed internally, or via external means in step 1300, to determine, in step 131, the appearance of the moon, and to choose, in step 132, whether to maintain angular control of the motor in step 133 for a white moon, or to impart an angular phase shift in step 134.

Figure 14:
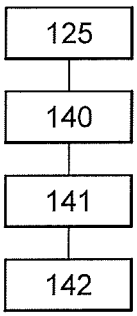
FIG. 14 is an algorithm for translation of the second display member with respect to the first display member.

FIG. 14 illustrates an algorithm for translation of second display member 8 with respect to first display member 6, after determining orientation and latitude, step 140: offset calculation, 141: rotational coupling and 142: relative translation.

Figure 15:
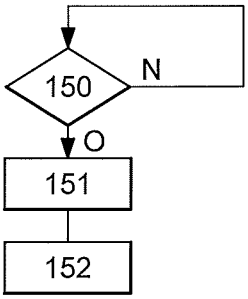
FIG. 15 is a speed control algorithm for a display with accelerated motion.

FIG. 15 illustrates a speed control algorithm for a display member with accelerated motion: in step 150: end-of-lunation test, 151: acceleration of the motor, 152: return to normal speed.

In short, an algorithm can precisely predict the appearance of the moon phase according to the date. Geolocation and/or indication of the terrestrial hemisphere of a place makes it possible to change the appearance and direction of rotation of first display member 6, notably a moon disc.

The connection between a mobile telephony device 100 and a watch 1000 allows for automatic setting, without user intervention.

The invention offers various advantages:

- the moon phase display is correct in relation to the current date and to the hemisphere of the place where the watch is located;
- setting is simplified;
- only one disc with a single moon is required, in the simple variant which does not handle display of the blood moon;
- the variant which handles display of the blood moon simply requires the moon disc to be adapted by adding a representation of the blood moon;
- utilising the latitude of the location transmitted by geolocation makes it possible to refine moon phase displays in equatorial, tropical and polar regions, which, until now, was only possible with very expensive, rare haute horlogerie timepieces,
- a tide display can be coupled to the moon display. Connection to an external resource is particularly advantageous since it allows special coastal features to be taken into account. It is possible to either transfer pre-calculated high and low tide times and the tide range, or to transmit values for the current day, and to recalculate future values using a polynomial whose coefficients are sent to the watch;
- a daylight saving time correction can be taken into account via the connection between a mobile telephony device and the watch, and is necessary for managing tide times.

What is claimed is:

1. A universal moon phase display device for a watch, comprising:

processing circuitry configured to calculate or receive the current date, receive a geolocation signal indicating the terrestrial hemisphere of a place, calculate, as a function of said current date, or receive a lunar calendar that includes at least the correlation between the current date and the moon phase, convert the day's moon phase into a first angular position value of a first display member included in said device, the first display member including at least one representation of the normal moon, determine the northern or southern hemisphere in which said device is located, and control the direction of rotation of a first drive included in said device in order to drive said first display member in a first direction in the northern hemisphere or in a second, opposite direction in the southern hemisphere in response to the determination.

2. The device according to claim 1, wherein said device comprises a second display member including at least one representation of the horizon, with respect to which said first display member is movable.

3. The device according to claim 2, wherein said second display member is movable at least in a concentric rotation with said first display member.

4. The device according to claim 3, wherein processing circuitry is further configured to calculate the latitude of the place where said device is located, and control a second drive included in said device in order to drive said second display member with respect to said first display member based on the calculated latitude.

5. The device according to claim 2, wherein said processing circuitry is further configured to calculate the latitude of the place where said device is located, and control a second drive included in said device in order to drive said second display member with respect to said first display member based on the calculated latitude.

6. The device according to claim 2, wherein said first drive includes at least a first electric motor arranged to rotate in only one direction of rotation, wherein said processing circuitry is further configured to control the speed of said first drive to drive said first display member at a first speed, in a first trip, wherein said at least one normal moon representation is visible, between a beginning-of-lunation position and an end-of-lunation position, to make one complete trip in one lunar month, in a limited angular travel strictly less than 360°, and drive said first display member, at the end of the lunation, at a second speed at least thirty times greater than said first speed, in a second trip, wherein said at least one normal moon representation is not visible, between said end-of-lunation position and said beginning-of-lunation position, in a movement of duration less than or equal to one day.

7. The device according to claim 1, wherein said first drive includes at least a first electric motor configured to rotate in both directions of rotation, in order to drive said first display member in a first direction, between a beginning-of-lunation position and an end-of-lunation position, to make one complete travel in one lunar month, in a limited angular travel strictly less than 360°, and drive said first display member, at the end of a lunation, in a second direction opposite to the first direction, between said end-of-lunation position and said beginning-of-lunation position, in a substantially instantaneous backward motion.

8. The device according to claim 1, wherein said first display member includes a single representation of the moon which is said normal moon representation.

9. The device according to claim 1, wherein said lunar calendar includes the dates of total lunar eclipses and blood moon days, wherein said first display member includes, in distinct angular positions, at least one normal moon representation which is displayed by default and at least one blood moon representation, and wherein said processing circuitry is further configured to effect a rotation of said first drive to substitute a blood moon representation for a normal moon representation, when the current date corresponds to a blood moon date.

10. The device according to claim 1, wherein said processing circuitry is further configured to receive a signal transmitted by a satellite or by a mobile telephony device carryable by a user of said watch.

11. A watch comprising at least one device according to claim 1.

12. A portable assembly comprising a watch according to claim 11 and a mobile telephony device arranged to provide a geolocation signal or data and/or a signal or data indicating the terrestrial hemisphere of a place, and/or a date signal or data to a said device included in said watch.

13. The device according to claim 1, wherein the processing circuitry is configured to control the direction of rotation of a first drive included in said device by instructing changing of the rotation direction of an electric motor in the first drive.

* * * * *